United States Patent [19]

Lawlor et al.

[11] Patent Number: 4,840,375

[45] Date of Patent: Jun. 20, 1989

[54] PINBALL MACHINE

[76] Inventors: Patrick M. Lawlor, 24308 Tomlin Rd., Marengo, Ill. 60152; Lawrence E. DeMar, 1660 North LaSalle St., Chicago, Ill. 60614

[21] Appl. No.: 63,126

[22] Filed: Jun. 17, 1987

[51] Int. Cl.[4] ..... A63D 3/02; A63F 7/22

[52] U.S. Cl. ..... 273/121 A; 273/121 B; 273/121 E; 273/119 A

[58] Field of Search ..... 273/109, 110, 120, 118 A, 273/121 B, 121 A, 121 E, 119 A

[56] References Cited

U.S. PATENT DOCUMENTS

| | | | |
|---|---|---|---|
| 2,098,320 | 7/1934 | Traver | 273/122 |
| 2,646,986 | 7/1953 | Mentzer | 273/121 |
| 2,713,488 | 7/1955 | Magrath | 273/121 |
| 2,782,037 | 2/1957 | Rovira | 273/122 |
| 2,926,915 | 3/1960 | Johns | 273/121 |
| 3,384,375 | 5/1968 | Zifferblatt | 273/123 |
| 3,441,279 | 4/1969 | Lally et al. | 273/121 R |
| 3,582,074 | 6/1971 | Menotti | 273/121 R |
| 3,897,951 | 8/1975 | Morrison et al. | 273/121 A |
| 4,055,342 | 10/1977 | Matsumoto | 273/121 R |
| 4,311,311 | 1/1982 | Crosman | 273/121 A |
| 4,606,545 | 8/1986 | Ritchie | 273/121 A |

FOREIGN PATENT DOCUMENTS 2040777 3/1972 Fed. Rep. of Germany ... 273/121 R

OTHER PUBLICATIONS

"Play Meter", Roger Sharpe, Stern's Catacomb, Jan. 1, 1982, Still Crasy Photographs.

Collection of 12 Animated Back Glass Advertisements.

*Primary Examiner*—Edward M. Coven

*Assistant Examiner*—Gary Jackson

*Attorney, Agent, or Firm*—Willian, Brinks, Olds, Hofer, Gilson & Lione

[57] ABSTRACT

A pinball machine has a horizontal playfield as well as a vertical playfield. The playfields are preferably integrated to permit a ball put into play on the horizontal playfield to be carried into the vertical playfield for continued play of the same ball. An elevator mechanism is therefore provided in the form of an electromagnet carried by a motor driven winch. The electromagnet carries the ball from the horizontal playfield along a vertical path for release on a retractable landing. The ball rolls off the landing into play, with one or more flippers on the vertical playfield used to propel the ball under player control. "Mouseholes" are further provided on the vertical playfield which lead to hidden conduits behind the playfield surface through which the ball rolls. Scoring displays set flush with the vertical playfield surface form part of the playfield.

29 Claims, 2 Drawing Sheets

PINBALL MACHINE

FIELD OF THE INVENTION

This invention relates to pinball games, and in particular to a novel pinball machine having a generally horizontal playfield and a generally vertical playfield.

BACKGROUND OF THE INVENTION

A conventional pinball machine has a generally horizontal playfield over which a pinball rolls. A variety of devices are typically incorporated on the playfield with which the ball interacts, such as drop-targets, roll-over switches, bumpers, spinner lanes, kickers and the like. At least one set of flippers is also ordinarily provided on the playfield, which are operated by a player using external control buttons.

The object of the game is to keep the ball in play as long as possible, while at the same time amassing as high a score as possible. A numerical display typically records the score, with a plurality of such displays being provided for a number of competing players. The numerical displays are almost universally set in the back glass assembly of the pinball machine. The back glass also has the usual game score, credit and ball-in-play displays, and may in addition contain some of the electronics of the machine.

Designers of pinball machines seek innovations which will spark the interest of new as well as old players, while also challenging the skill of veteran pinball aficionados. Pinball machines have thus shown a continual development of new play features, such as point jackpots which are reached only after the sequential engagement of particular targets, and the integration of audio/visual stimulae with the play of the game.

Innovations in the playfields themselves have also been effected, such as the use of elevated ball pathways and bi-level playfields. U.S. Pats. Nos. 4,375,286 and 4,606,545 are representative of the same. The playfield of the game, whether bi-level or not, has almost always been in a generally horizontal plane, however. That is, the playfield, or playfields, have a slight slope downwardly (rear to front) for a relatively slow fall of the ball under the force of gravity.

Some substantially vertical playfields for game-balls have also been developed. None is known to use balls the size and mass of a pinball, and most simply have the ball fall in an uncontrolled manner through a maze of pins, pegs and the like. The pachinko game is one such vertical playfield device, in which a small size (i.e., low mass) ball is shot into play, and then rapidly falls through a sequence of pegs, spinners and the like to a collection trough. It will be noted that the fall of the ball is completely uncontrolled in the classic pachinko game. A recent variation on the pachinko game has included player-actuated flippers, as shown in U.S. Pat. No. 3,897,951. The skill element of "making a shot" with the flippers is substantially missing from the '951 device, however. The '951 balls also appear to be of the low-mass type typical of pachinko games.

While pinball machines with horizontal playfields are known, and pachinko-type machines with vertical playfields are known, no pinball machine having both a horizontal and vertical playfield appears to have been developed, until now.

SUMMARY OF THE INVENTION

The present invention is a pinball machine having a first generally horizontal playfield on which a ball can roll and engage targets and other ball actuated devices, and a second generally vertical playfield which also includes targets and ball actuated devices. Both horizontal and vertical playfields include at least one player operated mechanism, such as at least one flipper, for propelling a ball that has been put in play on the respective playfield.

A presently preferred application of the invention has the playfields interconnected so that a ball initially put in play on the horizontal playfield can be transported into play on the vertical playfield. To this end, a present embodiment provides a ball-capture area on the horizontal playfield adjacent the rear end of that playfield. An elevator mechanism associated with the vertical playfield carries the the ball from the ball-capture area to a release position on the vertical playfield.

A novel elevator mechanism has also been developed to carry the ball between playfields, and takes the form of an electromagnet which is raised and lowered by a motor driven winch. The electromagnet travels along a generally vertical path on the vertical playfield, with the ball-capture area being located at the lower end of the path.

At least one retractable landing is provided along the electromagnet path. Each landing comprises a floor upon which a ball is momentarily supported and then directed into play when released from the electromagnet, and a slot defined in the vertical playfield along the electromagnet path through which the floor moves. A device for moving the floor through the slot and into and out of the electromagnet path, such as a solenoid driver, completes the retractable landing mechanism.

The presently preferred embodiment of the invention further includes at least one hidden passageway for the ball in the vertical playfield. Each such hidden passageway has entrance and exit openings (or "mouseholes") defined in the vertical playfield through which the ball passes into and out of a conduit located behind the vertical playfield; the conduit extends between the entrance and exit openings. The ball passes out of play through the entrance opening and then back into play through the exit opening. The entrance opening is advantageously located at a higher point on the vertical playfield than the exit opening, so that the ball travels through the conduit under the force of gravity. The exit opening is also preferably located to direct the ball onto a flipper mechanism on the vertical playfield to enhance the play of the game.

At least one scoring display is located in the vertical playfield in the preferred embodiment. Each such scoring display has a face which is substantially flush with the surface of the vertical playfield, with the scoring display thus forming part of the vertical playfield surface.

It will be understood that, while the most advantageous application of the invention is presently considered to be in a pinball machine in which the same ball is used in play on both playfields, the invention is considered to encompass a pinball machine in which a separate ball is used for each of the respective horizontal and vertical playfields. The ball(s) thus need not be physically conveyed between the playfields.

The features and advantages of the invention will be further understood upon consideration of the following detailed description of an embodiment of the invention taken in conjunction with the drawings, in which:

DETAILED DESCRIPTION OF AN EMBODIMENT OF THE INVENTION

Figure 1:
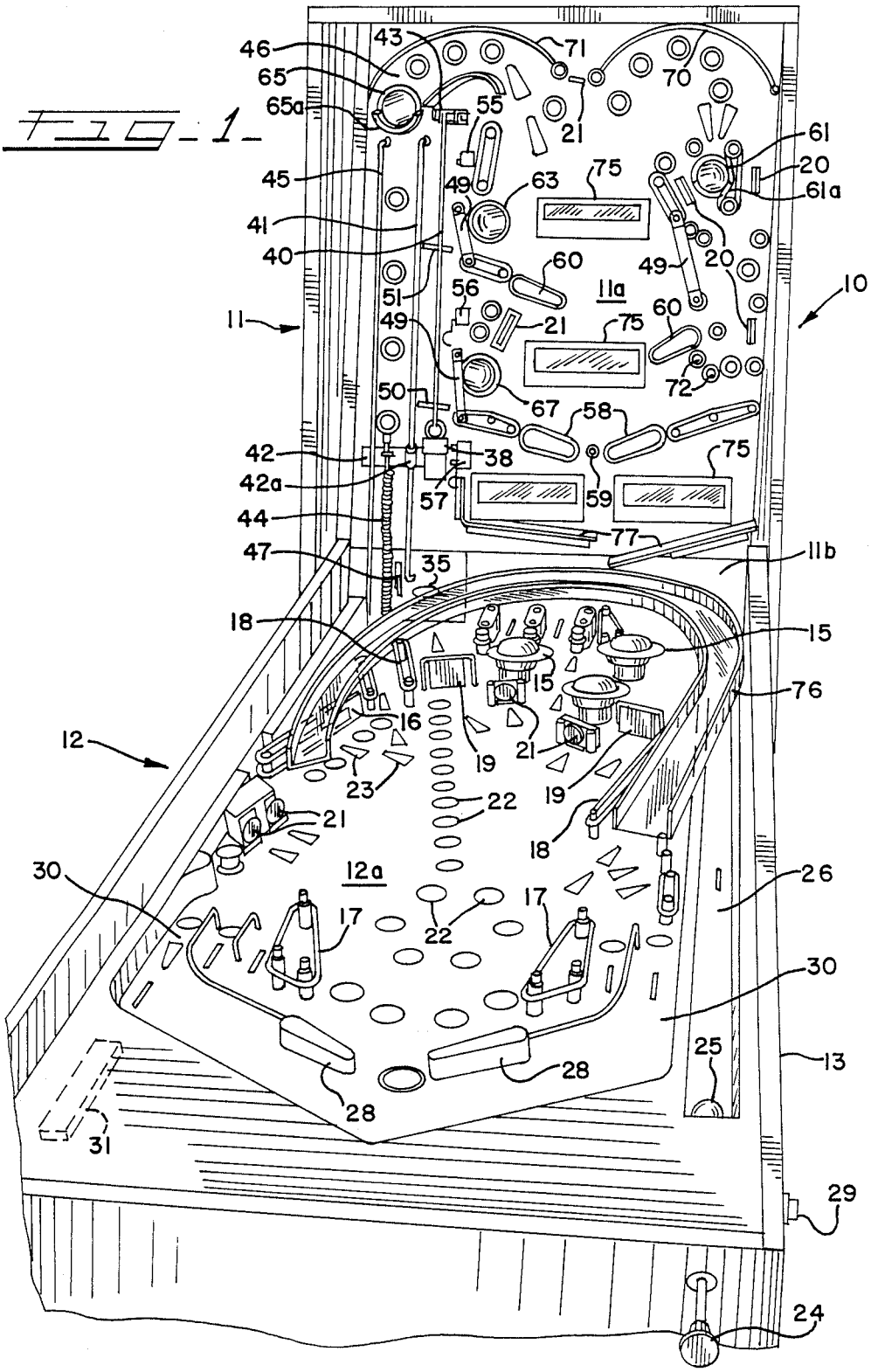
FIG. 1 is a perspective view of a pinball machine made in accordance with the teachings of the invention.

Pinball machine 10 has a vertical playfield 11 and a horizontal playfield 12. A cabinet 13 (here referring to the cabinet for the horizontal playfield 12 as well as the "backbox" for the vertical playfield 11) houses and supports the playfields, and has a set of supporting legs (not shown) for elevating the cabinet 13 to a convenient height. The glass typically provided over the horizontal playfield 12 and over the back glass area of the pinball machine 10 are not shown in these Figures, but it will be understood that the playfields are enclosed with such glass, plexiglass or the like.

It will also be understood at the outset that "horizontal" and "vertical" are used in a relative sense to describe the two playfields. The horizontal playfield 12 has a generally planar surface 12*a* which is inclined about 3–10 degrees to the horizontal. The vertical playfield 11 has a generally planar surface 11*a* which is inclined to the vertical about 15.5 degrees, in this embodiment. An acceptable angulation for the vertical playfield 11 is, however, presently considered to be in the range of about 5–25 degrees to the vertical. "Vertical" when used to describe playfield 11 thus implies generally vertical. "Horizontal" when used to describe playfield 12 thus means generally horizontal.

Horizontal playfield 12 may contain, for example, a plurality of pop-bumpers 15, drop targets 16, slingshot kickers 17, bumpers 18, spinner targets 19, and stand-up targets 21 which are located in a desired arrangement on the surface 12*a*. A plurality of circular inserts 22 and arrow-shaped inserts 23 of varying colors are recessed generally even with the surface 12*a*. Lights are disposed beneath each insert, and are controlled in a conventional manner and in accordance with a prearranged program, or in response to a ball engaged switch.

A spring-loaded plunger or shooter 24 is used to fire a pinball 25 into play on the horizontal playfield 12. The ball 25 passes along and out of an ejector lane 26 under the impetus of the manually actuated plunger 24. Now in play, the ball 25 then rolls under the influence of gravity downwardly over the slightly inclined playfield surface 12*a*. As the ball 25 falls, it engages the various ball directing and target elements along its path.

Additionally, flipper mechanisms 28 are provided that are controlled by solenoids which are responsive to left and right push buttons 29 operated by the player. Standard Williams Electronics Games, Inc., 50 volt DC flipper mechanisms were used herein. A ball 25 can pass out of play either by falling between the flippers 28, or by passing into either of the side-out-of-play lanes 30. The ball can then be automatically returned to the head of the plunger 24 for further play, or another ball can be fed to the plunger. Mechanisms for such ball return are well known in the art. Also, a kick-back solenoid 31 (shown schematically) may also be employed to place a ball back in play from the left side-out-of-play lane 30, for example.

The make-up of the horizontal playfield 12*a* may be widely varied with respect to the particulars of the scoring, targets, ball movement and the like. Controls for operating the scoring, target movement and audio/-visual operation of the game, such as according to some prearranged logic, are also well known to those of skill in the art.

The principal feature of the invention is the integration of both a horizontal and vertical playfield in a single pinball machine 10. In the illustrated embodiment, the vertical playfield 11 is located at the rear of the horizontal playfield 12. Vertical playfield surface 11*a* physically joins horizontal playfield surface 12*a* along a juncture at the rear of the horizontal playfield 12.

Located at the rear of the horizontal playfield 12 and adjacent the left side of the bottom of the vertical playfield 11 is a ball capture recess 35 formed in the horizontal surface 12*a*. Capture recess 35 is a standard eject hole which includes a ball sensor 36 located therein that detects the presence of the ball 25. Capture recess 35 may be left freely accessible to ball 25, or may be temporarily blocked by a gate, for instance, which renders the recess 35 accessible upon the compilation of a given score or actuation of certain targets (e.g., hitting six specific drop targets). In the present embodiment, the recess 35 is left freely accessible, with kick-out or pick-up determined by hitting certain targets or a "skill shot" (e.g., direct shot to the recess 35 from the plunger 24).

When a ball 25 is detected in the recess 35, and the pick-up sequence is enabled, an elevator mechanism is actuated for lifting the ball from the recess and into play on the vertical playfield 11. In this embodiment, the elevator takes the novel form of an electromagnet 38 which is carried by a small-scale winch along a path on the vertical playfield 11. The winch mechanism comprises an electric motor and reel combination 39 (schematically illustrated), and a winch cable or line 40.

The motor, such as a 12 volt DC Hi Torque 9 r.p.m. Ex 76–29 motor supplied by Multi-Products of Racine, WI, is reversible for winding up (raising) the electromagnet 38 and for unwinding (lowering) the electromagnet 38. A # EM-R 125 electromagnet supplied by Magnet Sales and Mfg. Co. of Culver City, CA was used herein.

Lowering of the electromagnet is initiated when the ball sensor 36 is tripped and the pick-up sequence is enabled. A small offset element 43 spaces the line 40 away from the through-bore in the vertical playfield surface 11*a* provided for the line. Current for the electromagnet 38 is supplied through coiled electric cable 44, which is carried by bracket 42 and is appropriately wired to the electromagnet and a power supply. Cable 44 extends through a hole in the horizontal playfield surface 12*a* through which it is withdrawn and retracted.

The electromagnet 38 is stabilized on its path by a guide rail 41 to which the electromagnet 38 is attached to slide as by bracket 42. Bracket 42 has a sleeve 42*a* (FIG. 1) formed thereon through which guide rail 41 extends. A second guide rail 45 extends parallel to guide rail 41. Bracket 42 bears against the guide rail 45 and levers the electromagnet 38 outwardly to prevent the latter from hanging-up on the vertical play surface.

Guiding the electromagnet in this manner also stabilizes the electromagnet against lateral tipping from improper installation, and helps resist the effects of player vibration. It will be further noted that a ball 25 once in play on the vertical playfield 11 will not pass into the region of the electromagnet path or beyond due to the close vertical proximity of vertical play surface elements adjacent the electromagnet path, which effectively form a barrier to leftward ball travel.

Energization of the electromagnet 38 to pick up the ball 25 occurs when the electromagnet actuates trip switch 47 located adjacent the recess 35. Actuation of switch 47 engages a command sequence in the game programming that reverses the winch motor, causing the line 40 to now be wound up on the reel. The ball 25 is then lifted to one of two landings 50 and 51 for release into play on the vertical playfield 11.

Each landing 50, 51 comprises a rectangular floor 52 which slides through a slot 53 that extends through the playfield surface 11*a*. A solenoid driver 54 (shown schematically in FIG. 3) is used to move the floor 52 through the slot 53.

The retractable floors 52 intersect the path of the electromagnet 38 when the floors are extended. The floors 52 are programmed to extend after the passage of the ball-laden electromagnet 38, with one or the other of the floors 52 being actuated for movement depending on the game programming. The movement of the electromagnet 38 is likewise made to coincide with the floor movement, so that the electromagnet stops immediately above a floor 52, which is then extended.

Figure 2:
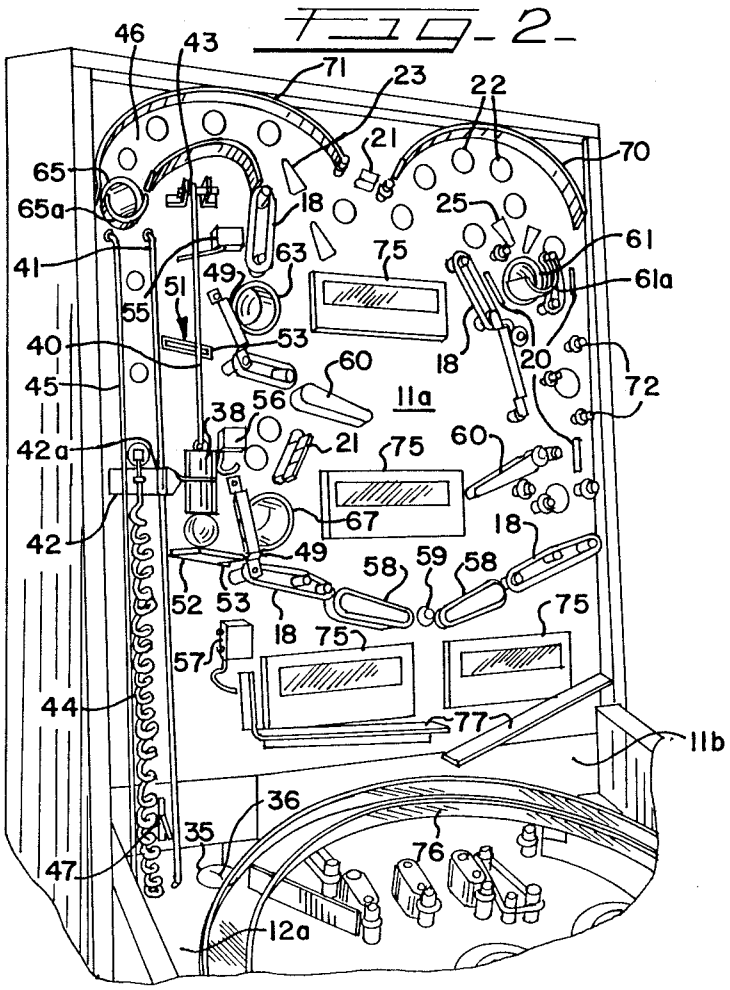
FIG. 2 is a slightly enlarged partial perspective view of the vertical playfield of the pinball machine of FIG. 1.

The solenoid driver 54 used herein was fabricated from standard "memory" drop-target mechanisms. The solenoid driver extends the floor 52 which catches on a relay bracket. Extension of the floor 52 simultaneously expands a return spring held by the relay bracket. When the relay bracket is actuated, as by a timing sequence in the game programming, the return spring is released causing the floor 52 to retract. Trip switches 55 and 56 (e.g., FIG. 2) are accordingly provided to trigger one or more of: electromagnet arrest, landing extension, and ball release. A trip switch 57 additionally provides a "home position" for the electromagnet 38. Standard Cherry Electric E21 and E63 microswitches can be used for switches 47 and 55–57.

Each floor 52 has a slight downward tilt toward the middle of the vertical playfield 11 to put the ball 25 into play. A ball 25 released from the electromagnet 38 thus comes to rest momentarily on a floor 52, and then rolls off through a one-way gate 49 into play. It will be understood that a single landing 51 could be used alone, or more than two landings could be provided, as desired.

Once in play on the vertical playfield 11, the ball can engage another collection of drop targets, bumpers 18, stand-up targets 21 and roll-over wire form switches 20, for example, which are located on the surface 11*a*. A plurality of circular inserts 22 and arrow shaped inserts 23 of varying colors are recessed generally even with the surface 11*a*, with associated lights disposed beneath each insert. Like the targets and lights of the horizontal playfield 12, those of the vertical playfield are controlled in a conventional manner and in accordance with a prearranged program, or in response to a ball-engaged switch.

A pair of flippers 58 are located on the vertical playfield on opposite sides of a post 59. The use of a post 59 between these upper flippers 58 has been found advantageous due to the rapid fall of the ball on the vertical surface 11*a* under the influence of gravity. The post 59 can be made retractable, however, to increase the degree of difficulty as a player masters the game. A standard Williams Electronics Game, Inc. flipper post mechanism 64 was adapted for use with the post 59 (shown schematically in FIG. 3) with slight modification for longer travel of the solenoid plunger normally used therewith.

Flippers 58 can be made to operate in tandem with flippers 28, such that pressing the right flipper button 29 causes both of the right flippers of flippers 28, 58 to fire simultaneously. Flippers 28 can also be disengaged for play on the vertical playfield 11, with flippers 58 thereby only being operated by buttons 29 for vertical playfield play. The latter arrangement was used herein.

Another pair of flippers 60 is also provided above the flippers 58. These flippers 60 are arranged to operate in tandem with respective flippers 58, with all of the flippers operated by the flipper control buttons 29.

Flippers 60, while being useful simply to keep a ball 25 in play and hit targets on the vertical playfield 11*a*, also serve as the primary means to propel the ball 25 into either of two skill shots. One such skill shot is propelling the balls 25 into a chute 46. The other skill shot lands the ball 25 in a "mousehole" entrance 61.

Figure 3:
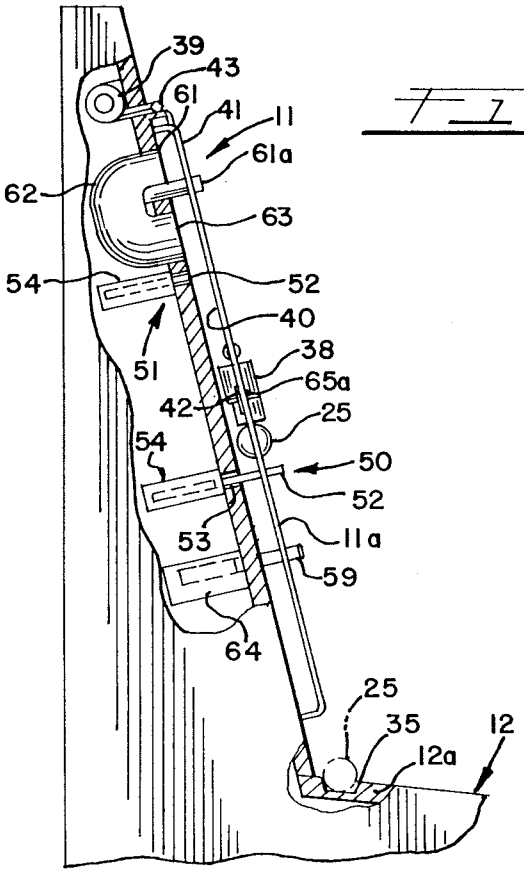
FIG. 3 is an elevational view of the vertical playfield of FIG. 2 partially broken away to particularly show one hidden conduit and the retractable landings (the latter being shown schematically).

"Mousehole" entrance 61 is an opening to a hidden conduit 62 which runs behind the playfield surface 11*a*. "Mousehole" entrance 61 has a curved lower lip 61*a* on which ball 25 lands to enter the conduit 62. As best seen in FIG. 3, the lip 61*a* and conduit 62 are tipped rearwardly to cause the ball 25 to move into the conduit.

The conduit 62, made from circular crosssection 1.25 inch inside diameter PVC tubing, has a downhill slope from the entrance 61 to a "mousehole" exit 63. Exit 63 is generally flush with the playfield surface 11*a*, with the slope of the conduit 62 sufficient to propel the ball back into play. The "mousehole" exit 63 is advantageously located in the vicinity above a flipper 60 to enhance game action.

A similar "mousehole" arrangement is used with the chute 46. A second "mousehole" entrance 65 with a lip 65*a* is situated in the chute 46. A ball entering the chute 46 thus lands on lip 65*a*, and then rolls downwardly through a conduit 66 (not shown in FIG. 3 for clarity of other elements depicted) and then out of a "mousehole" exit 67 and back into play. "Mousehole" exit 67 is likewise located in the vicinity above a flipper 58.

It will be noted that arcuate guides 70 and 71 are provided at the top of the vertical playfield 11. A number of bumper posts 72 are mounted on the playfield surface 11*a* to enhance ball action. A plexiglass cover (not shown) for the vertical playfield 11 is located fairly close to the playfield surface 11*a* in order to better contain a ball 25 on the vertical playfield surface 11*a*. Spacing of the plexi-glass 1.5 inches from the surface 11*a* provides clearance for posts 72 and other playing surface components, with satisfactory ball containment on the playfield surface 11*a*.

The vertical playfield 11 also includes a plurality of scoring displays 75 which are set with their faces substantially flush with the playfield surface 11*a*. The scoring displays 75, which are standard equipment, thus become part of the playfield 11*a* and add to the visual appeal of the game.

When a ball 25 passes out of play on the vertical playfield 11, as by passing between the flippers 58, it drops onto one or both of two inclined fall-arrest ramps 77. Fall-arrest ramps 77 break the fall of the ball 25, and direct it into an elevated ramp 76 located on the horizontal playfield 12. The ball 25 is then directed by the ramp 76 back into play on the horizontal playfield 12. A slight cut-out or indentation 11*b* is provided in the playfield surface 11*a* to locate a portion of the ramp 76 immediately beneath the lower end of the playfield surface 11*a*, to assure that the ball 25 lands in the ramp 76. Ramp 76 is transparent, and has raised sidewalls to contain the ball 25 on the ramp. It will be seen that elevated ramp 76 can also be employed during play on the horizontal playfield separate from its function as a ball return for the vertical playfield.

Thus, while the invention has been described with reference to a particular embodiment, those of skill in art will recognize modifications of structure and arrangement that still fall within the scope of the invention and the following claims.

What is claimed is:

1. A pinball machine comprising:

a first generally horizontal playfield which includes targets and at least one means operable by a player for propelling a ball that has been put in play on the first playfield, and a second generally vertical non-pachinko playfield which includes targets and at least one means operable by a player for repeatedly propelling a ball that has been put in play on the second playfield in a manner in which said ball can be indefinitely kept in play on said second playfield.

2. A pinball machine comprising:

a first playfield which is inclined at a small angle to the horizontal, and a second playfield which is inclined at a large angle to the horizontal, each playfield including targets and at least one means operable by a player for repeatedly propelling a standard mass pinball that has been put in play on a respective playfield in a manner in which said ball can be indefinitely kept in play on either of said playfields.

3. A pinball machine comprising:

a first playfield which is inclined at a generally small angle to the horizontal and having a rear end and a front end, with said first playfield sloping downwardly from said rear end to said front end, a second non-pachinko playfield which is inclined at a generally small angle to the vertical and having a top end and a bottom end, with said second playfield sloping downwardly from said top end to said bottom end, said second playfield extending from said first playfield rear end, and means supported by each of said playfields and operable by a player for repeatedly propelling a ball that has been put in play on a respective playfield in a manner in which said ball can be indefinitely kept in play on either of said playfields, and ball actuated devices on each said playfield for effecting a selected pinball operation when engaged by a ball.

4. The pinball machine of claim 3 further including means for conveying a ball in play on said first playfield to said second playfield for play of the same ball on said second playfield.

5. The pinball machine of claim 3 wherein said ball propelling means includes flipper mechanisms on each of said playfields, said second playfield including a lower set of flipper mechanisms and at least one upper flipper mechanism.

6. The pinball machine of claim 3 further including at least one scoring display located in said second playfield, each said scoring display having a face which is substantially flush with the surface of said second playfield with said scoring display forming part of said second playfield surface.

7. The pinball machine of claim 4 further including at least one ramp means adjacent said bottom end of said second playfield for breaking the fall of the ball, and for directing the ball to a preselected position on the first playfield.

8. The pinball machine of claim 7 further including an inclined ramp carried by said first playfield, said inclined ramp having a portion spaced above said first playfield and beneath said second playfield, said second playfield ramp means directing the ball into said portion of said first playfield ramp to put the ball into play on said first playfield.

9. The pinball machine of claim 4 wherein said ball propelling means comprise a pair of flippers for each playfield, said flipper pair for said second playfield being located near said bottom end, and further including a post located between said second playfield flippers, said post being spaced a distance from an inward end of each of said second playfield flippers which is smaller than the diameter of the ball, such that the ball cannot pass between said post and a second playfield flipper when the latter is in a rest position, and means for moving said post from between said second playfield flippers.

10. A pinball machine comprising:

a first playfield which is inclined at a generally small angle to the horizontal and having a rear end and a front end, with said first playfield sloping downwardly from said rear end to said front end, a second playfield which is inclined at a generally small angle to the vertical and having a top end and a bottom end, with said second playfield sloping downwardly from said top end to said bottom end, said second playfield extending from said first playfield rear end, means supported by each of said playfields and operable by a player for repeatedly propelling a ball that has been put in play on a respective playfield in a manner in which said ball can be indefinitely kept in play on either of said playfields, ball actuated devices on each said playfield for effecting a selected pinball operation when engaged by a ball, a ball-capture area on said first playfield adjacent said first playfield rear end, elevator means for carrying the ball from said ball-capture area to a release position on said second playfield, means for sensing the presence of a ball in said ball-capture area and for engaging said elevator means, and means for releasing the ball from said elevator means.

11. The pinball machine of claim 10 wherein said elevator means comprises:

an electromagnet, a winch mechanism for raising and lowering said electromagnet along a path on said second playfield, with said ball-capture area being located at the lower end of said electromagnet path, and a motor for driving said winch mechanism.

12. The pinball machine of claim 11 further including at least one retractable landing located along said electromagnet path, each said landing comprising:

a floor upon which a ball is momentarily supported when released from said electromagnet, a slot defined in said second playfield along said electromagnet path through which said floor moves, and means for moving said floor into and out of said electromagnet path.

13. The pinball machine of claim 12 further including at least one hidden ball passageway in said second playfield, each said hidden passageway comprising:

an entrance opening defined in said second playfield through which the ball passes into said passageway, an exit opening defined in said second playfield through which the ball passes out of said passageway, and a conduit located behind said second playfield extending between said entrance and exit openings, and through which the ball passes out of play through said entrance opening and then back into play through said exit opening.

14. The pinball machine of claim 13 wherein said entrance opening is located at a higher point on said second playfield than said exit opening, such that the ball travels through said conduit under the force of gravity.

15. A pinball machine comprising:

a first generally horizontal playfield which includes targets and at least one flipper means operable by a player for propelling a ball that has been put in play on said first playfield, and a second generally vertical playfield which includes targets and at least one flipper means operable by a player for propelling a ball that has been put in play on said second playfield, and elevator means for conveying a ball in play on said first playfield to said second playfield for play of the same ball on said second playfield.

16. The pinball machine of claim 15 wherein said ball conveying means comprises:

a ball-capture area on said first playfield adjacent said first playfield rear end, said elevator means carrying the ball from said ball-capture area to a release position on said second playfield, means for sensing the presence of a ball in said ball-capture area and for engaging said elevator means, and means for releasing the ball from said elevator means.

17. The pinball machine of claim 16 wherein said elevator means comprises:

an electromagnet, a winch mechanism for raising and lowering said electromagnet along a path on said second playfield, with said ball-capture area being located at the lower end of said electromagnet path, and a motor for driving said winch mechanism.

18. The pinball machine of claim 17 further including at least one retractable landing located along said electromagnet path, each said landing comprising:

a floor upon which a ball is momentarily supported when released from said electromagnet, a slot defined in said second playfield along said electromagnet path through which said floor moves, and means for moving said floor into and out of said electromagnet path.

19. The pinball machine of claim 18 further including at least one hidden ball passageway in said second playfield, each said hidden passageway comprising:

an entrance opening defined in said second playfield through which the ball passes into said passageway.

an exit opening defined in said second playfield through which the ball passes out of said passageway, and a conduit located behind said second playfield extending between said entrance and exit openings, and through which the ball passes out of play through said entrance opening and then back into play through said exit opening, said entrance opening being located at a higher point on said second playfield than said exit opening, such that the ball travels through said conduit under the force of gravity.

20. The pinball machine of claim 19 further including at least one scoring display located in said second playfield, each said scoring display having a face which is substantially flush with the surface of said second playfield with said scoring display forming part of said second playfield surface.

21. The pinball machine of claim 15 further including at least one inclined ramp adjacent a bottom end of said second playfield for breaking the fall of the ball, and for directing the ball to the first playfield, and further including an inclined ramp carried by said first playfield, said inclined ramp of said first playfield, having a portion spaced above said first playfield and beneath said second playfield, said inclined ramp of said second playfield directing the ball into said portion of said ramp of said first playfield to put the ball into play on said first playfield.

22. The pinball machine of claim 15 wherein each playfield has a pair of flippers, said flipper pair for said second playfield being located near a bottom end of said second playfield, and further including a post located between said second playfield flippers, said post being spaced a distance from an inward end of each of said second playfield flippers which is smaller than the diameter of the ball, such that the ball cannot pass between said post and a second playfield flipper when the latter is in a rest position, and means for moving said post from between said second playfield flippers.

23. A pinball machine comprising:

a playfield which is inclined at a generally small angle from the vertical and having a top end and a bottom end, with said playfield sloping downwardly from said top end to said bottom end, flipper means supported by said playfield and operable by a player for propelling a pinball that has been put in play on said playfield, pinball actuated devices on said playfield for effecting a selected pinball operation when engaged by a pinball, a pinball-capture area on said playfield adjacent said bottom end, elevator means for carrying the pinball from said pinball-capture area to a release position higher on said playfield, means for sensing the presence of a pinball in said pinball-capture area and for engaging said elevator means, and means for releasing the pinball from said elevator means.

24. The pinball machine of claim 23 wherein said elevator means comprises:

an electromagnet, a winch mechanism for raising and lowering said electromagnet along a path on said playfield, with said ball-capture area being located at the lower end of said electromagnet path, and a motor for driving said winch mechanism.

25. The pinball machine of claim 24 further including at least one retractable landing located along said electromagnet path, each said landing comprising:

a floor upon which a ball is momentarily supported when released from said electromagnet, a slot defined in said playfield along said electromagnet path through which said floor moves, and means for moving said floor into and out of said electromagnet path.

26. The pinball machine of claim 23 further including at least one scoring display located in said playfield, each said scoring display having a face which is substantially flush with the surface of said playfield with said scoring display forming part of said playfield surface.

27. The pinball machine of claim 23 wherein said flipper means comprises a pair of flippers for said playfield, said flipper pair being located near said bottom end, and further including a post located between said flippers, said post being spaced a distance from an inward end of each of said flippers which is smaller than the diameter of the ball, such that the ball cannot pass between said post and a flipper when the latter is in a rest position, and means for moving said post from between said flippers.

28. A pinball machine comprising:

a playfield which is inclined at a large angle to the horizontal, targets and at least one flipper means operable by a player for propelling a ball that has been put in play on said playfield, at least one hidden ball passageway in said playfield, each said hidden passageway having an entrance opening defined in said playfield through which the ball passes into said passageway, an exit opening defined in said playfield through which the ball passes out of said passageway, and a conduit located behind said playfield extending between said entrance and exit openings, and through which the ball passes out of play through said entrance opening and then back into play through said exit opening, said entrance opening being located at a higher point on said second playfield than said exit opening, such that the ball travels through said conduit under the force of gravity.

29. The pinball machine of claim 28 including a lower set of flipper mechanisms and an upper set of flipper mechanisms.

* * * * *

UNITED STATES PATENT AND TRADEMARK OFFICE

CERTIFICATE OF CORRECTION

PATENT NO. : 4,840,375

DATED : June 20, 1989

INVENTOR(S) : Patrick M. Lawlor et al.

It is certified that error appears in the above-identified patent and that said Letters Patent is hereby corrected as shown below:

IN THE REFERENCES CITED

On the cover sheet in col. 1, at the end of the list entitled "U.S. PATENT DOCUMENTS", please add --4,375,286 3/1983 Sietz et al.....273/121 A--.

IN THE OTHER PUBLICATIONS

On the cover sheet in col. 2, please delete "Crasy" and substitute therefor --Crazy--.

IN THE SUMMARY OF THE INVENTION

In col. 2, line 19, please delete the first occurrence of "the".

IN THE DETAILED DESCRIPTION OF AN EMBODIMENT OF THE INVENTION

In col. 5, line 57, please delete "arrow shaped" and substitute therefor --arrow-shaped--.

In col. 6, line 4, please delete "Game" and substitute therefor --Games--.

In col. 7, line 14, after "in" please insert --the--.

IN THE CLAIMS

In col. 7, line 24, please delete "non-pachinko".

In col. 7, line 29, please delete "on" and substitute therefor --over substantially all of--.

UNITED STATES PATENT AND TRADEMARK OFFICE

CERTIFICATE OF CORRECTION

PATENT NO. : 4,840,375

DATED : June 20, 1989

INVENTOR(S) : Patrick M. Lawlor et al

It is certified that error appears in the above-identified patent and that said Letters Patent is hereby corrected as shown below:

In col. 7, line 37, delete "standard mass".

In col. 7, line 39, delete "on either" and substitute therefor --over all--.

In col. 8, line 20, delete "comprise" and substitute therefor --comprises --.

In col. 9, line 45, after the last comma, insert a subparagraph.

In col. 10, line 8, delete "." and substitute therefor --,--.

In col. 12, line 23, delete "second".

Signed and Sealed this

Twenty-eighth Day of August, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,840,375

DATED : June 20, 1989

INVENTOR(S) : Patrick M. Lawlor, et al

It is certified that error appears in the above-identified patent and that said Letters Patent is hereby corrected as shown below:

Col. 7, line 46, delete "non-pachinko".

Col. 7, line 56, delete "on either" and substitute therefor --over substantially all of the area--.

Col. 7, line 57, delete "playfield" and substitute therefor --playfields--.

Col. 9, line 34, delete "and".

Col. 9, line 38, after "playfield" insert --in a manner in which said ball can be indefinitely kept in play over substantially all of said second playfield--.

Signed and Sealed this

Eighteenth Day of June, 1991

*Attest:*

HARRY F. MANBECK, JR.

*Attesting Officer*

*Commissioner of Patents and Trademarks*